United States Patent [19]

Hollingsead et al.

[11] 4,075,444

[45] Feb. 21, 1978

[54] ELECTRICAL CONNECTOR STRUCTURE

[75] Inventors: Robert Allen Hollingsead, La Habra; Abraham Kuchler; Clyde Robert Pryor, both of Anaheim, all of Calif.

[73] Assignee: Hollingsead-Pryor Enterprises, Inc., Santa Fe Springs, Calif.

[21] Appl. No.: 647,903

[22] Filed: Jan. 9, 1976

Related U.S. Application Data

[63] and a continuation-in-part of Ser. No. 613;348, Sept. 15, 1975, Continuation-in-part of Ser. No. 535,288, Dec. 23, 1974, abandoned.

[51] Int. Cl.[2] ..... H01R 33/30

[52] U.S. Cl. ..... 200/51.09; 339/75 M

[58] Field of Search ..... 200/51.08, 51.09, 50 B; 317/101 CB, 101 OH; 339/64 M, 65, 75 R, 75 M, 75 MP

[56] References Cited

U.S. PATENT DOCUMENTS

| | | | |
|---|---|---|---|
| 2,855,454 | 10/1958 | Alden | 317/101 CB |
| 3,478,301 | 11/1969 | Conrad et al. | 339/75 MP |
| 3,488,623 | 1/1970 | Stephenson et al. | 339/64 M |
| 3,846,598 | 11/1974 | Mucsi | 200/51.09 |

FOREIGN PATENT DOCUMENTS

| | | | |
|---|---|---|---|
| 2,014,868 | 10/1971 | Germany | 339/75 M |
| 2,213,639 | 10/1973 | Germany | 317/101 CB |
| 2,257,524 | 5/1973 | Germany | 200/51.09 |
| 580,397 | 8/1958 | Italy | 200/51.09 |
| 1,274,311 | 5/1972 | United Kingdom | 317/101 CB |

*Primary Examiner*—David Smith, Jr.
*Attorney, Agent, or Firm*—Jackson & Jones Law Corporation

[57] ABSTRACT

An electrical connector structure is disclosed having low, or zero, insertion force interengaging terminals which do not engage initially as the connector mating portions are moved together, but which are automatically moved into engagement as the mating portions are moved into their fully mated position. This automatic engagement results from a lever, or cam, effect which converts relative telescoping motion of the mating portions into relative lateral motion of the low insertion force terminals therein.

22 Claims, 16 Drawing Figures

ELECTRICAL CONNECTOR STRUCTURE

REFERENCE TO RELATED APPLICATIONS

This application is a continuation-in-part of application Ser. No. 535,288, filed Dec. 13, 1974. Application Ser. No. 613,348, filed Sept. 15, 1975, is also a continuation-in-part of the same parent application.

BACKGROUND OF THE INVENTION

This invention relates to electrical connector systems having mating portions which are brought together to provide a plurality of interengaging electrical contacts. Such systems are used to facilitate connection and disconnection of electronic components. They commonly are designed to be used in conjunction with a "box-and-tray" arrangement, or "racking" system, in which a modular electronic control or communication unit enclosed in a suitable container is mounted on, and supported by, a shelf, or rack, which is secured in place in the environment into which the modular electronic unit is to be inserted. For example, modern aircraft are supplied with such trays, which are normally retained in position on the aircraft, and which are adapted to receive and support boxes containing modular electronic units, such as radio communication units, aircraft instrumentation, and component control units, etc. When servicing is required, a given box is removed from the tray and replaced by another. The connection and disconnection of the box, in order to be quickly and efficiently accomplished, requires mating electrical connector sections, one mounted on the tray and wired to the permanent aircraft electrical and electronic systems, and the other mounted on the box and wired to the electrical and electronic systems contained in the box. Each mating connector section carries a number of electrical terminals adapted to engage corresponding electrical terminals on the other.

The density of the electrical connector contacts for use in electronic racking systems has increased over the years due to the increased requirements for signal and power connections to complex electronic modules or black boxes, such as computers, monitoring equipment, etc. This increased contact density requires large forces (insertion forces) to mate the connector shells of the conventional prior art connectors. At the same time, the large capital investment in aircraft, and also in ground based electronic racking systems, demands maximum operational utilization. Defective or faulty electronic modules must be easily removed and replaced by substitute modules. Large insertion forces often result in bent or broken contacts which require the replacement of one or both of the integrating connector terminals, and may require the replacement of an expensive electronic module.

Numerous efforts have been made to deal with the problem of excessive force needed to bring conventional connector mating sections into engagement. One proposed solution to this problem is low, or zero, insertion force electrical connectors. In such connectors the contact terminals are not in axial alignment with their corresponding terminals as the two connector mating portions are brought together by relative motion toward one another. Instead the opposing terminals are laterally spaced until the mating portions have been brought together; and thereafter, the set of terminals in one portion is moved laterally, or sideward, into engagement (and therefore, electrical contact) with the corresponding terminals in the other portion.

The low insertion force arrangement is designed to minimize the resistance to interengaging movement of the two connector mating sections which otherwise would result from the sum of all the terminal mating forces plus extra resistances caused by any misalignment problems in the connector system.

In the field of low insertion force connectors, Saul et al., U.S. Pat. No. 2,654,872 (1953) discloses a connector wherein the separate terminals can be physically brought into contact position under light pressure, and then the pressure substantially increased by virtue of a rotatable eccentric cam-shaft to insure good electrical conductivity. Bishop et al., U.S. Pat. No. 2,802,189 (1957) and Blackhall, U.S. Pat. No. 2,744,968 (1956) disclose multiple jack connections wherein cam levers force reed switches into contact after an initial non-contacting alignment.

Modifications of these structures have been provided in a large body of patent art, of which the following are cited as examples: Mishelevich et al., U.S. Pat. No. 3,145,067 (1964); Shlesinger, U.S. Pat. No. 3,217,284 (1955); Peterson, U.S. Pat. No. 3,315,212 (1967); Asick, U.S. Pat. No. 3,392,235 (1968); Feeser et al., U.S. Pat. No. 3,430,183 (1969); Brendlen, (U.S. Pat. No. 3,453,586 (1969); Frederick, U.S. Pat. No. 3,489,968 (1970); Lockhard et al., U.S. Pat. No. 3,539,970 (1970); Anhalt, U.S. Pat. No. 3,587,037 (1971); Anhalt, U.S. Pat. No. 3,594,698 (1971); Barker, U.S. Pat. No. 3,601,759 (1971); Hartley, U.S. Pat. No. 3,629,788 (1971); Walkup, U.S. Pat. No. 3,683,317 (1972); and Lightner, U.S. Pat. No. 3,848,222 (1974).

In addition, various arrangements have been proposed for making electrical contact between a printed circuit board and electrical connectors, such as Pferd, U.S. Pat. No. 3,188,598 (1965); Conrad et al., U.S. Pat. No. 3,478,301 (1969); and McIver et al., U.S. Pat. No. 3,555,488 (1971).

While low insertion force concepts are potentially very useful in solving the problems experienced with electrical connector systems, we believe that the low insertion force solution does not, of itself, provide a full answer to the needs of modern connector systems. Since one of the primary causes of difficulty is human error in handling the insertion and extraction of electronic modular units, we are interested in simplifying the connection and disconnection process so that difficulties and delays owing to mistakes in handling the equipment are minimized.

The prior art mating connector devices which incorporate low insertion force terminals require an additional action by the installer when a new modular unit is being mounted on the shelf, i.e., an action beyond that required by mating connector devices which incorporate pin-and-socket telescoping terminals. In the connectors using pin-and-socket terminals, the installer places the modular unit on the shelf, pushes it against the backing plate, and then secures the hold-down mechanism. In the low insertion force devices of the prior art, an additional step is required—the step of manually moving a cam or lever to bring the low insertion force terminals into contact position.

SUMMARY OF THE INVENTION

Our connector system, which is particularly useful in an avionics racking system, or modular unit and shelf combination, provides a low, or zero, insertion force connector in which terminals in one of the mating portions of the connector are automatically moved laterally, or transversely, into engagement with corresponding terminals in the other mating portion of the connector as the two mating portions are moved toward their final mated, or fully connected, position. This is accomplished by lever, or camming, means which converts the relative axial motion of the mating portions into transverse motion of terminals in one of the mating portions as they near their fully connected positions. This transverse motion brings the low insertion force terminals into their electrical contact position. Means are also provided for exerting resilient force tending to hold the low insertion force terminals in electrical contact after they have been transversely moved.

The connector mating portions are shown installed in an electrical racking system, in which one mating portion is secured to a backplate on the supporting shelf, and the other is secured to the electronic equipment module; and the two mating portions are brought into mating position by sliding the module along the shelf toward the backplate. Each of the connector shells preferably contains both low insertion force terminals and telescopically-engaging terminals.

With our invention, the installation of a modular unit on a racking shelf becomes at least as simple and error-proof for a connector having low insertion force terminals as it would be for a connector not having the benefits of such terminals. The automatic conversion of relative telescoping motion of the connector mating portions into relative lateral, or transverse, motion of the low insertion force terminals permits the installer to complete installation by merely pushing the modular unit against the backplate and securing the hold-down mechanism.

BRIEF DESCRIPTION OF THE DRAWINGS

FIGS. 7 through 10 are vertical cross-sectional views showing the two connector mating portions of the previous figures as they are being brought into their mated position;

FIG. 7 shows the two mating portions as the levers mounted on one portion begin entry into slots in the other portion;

FIG. 8 shows the relative positions of the two portions after the levers have moved a substantial distance into the slots, and while the levers are functioning to hold the low insertion force terminals out of engagement with one another;

FIG. 9 shows the relative portions of the two portions just before the levers start to push the low insertion force terminals into engagement; and FIG. 10 shows the positions of the two mating portions after the levers have caused the low insertion force terminals to come into engagement, but slightly before final mating position has been reached.

The remaining figures are identical with some of the figures in our parent application, Ser. No. 535,288, except that the detail-identifying numerals used in the two applications are not the same. These figures show structures which are functionally similar to those shown in FIGS. 1 to 10, but they represent a different embodiment of the generic invention.

Figure 6:
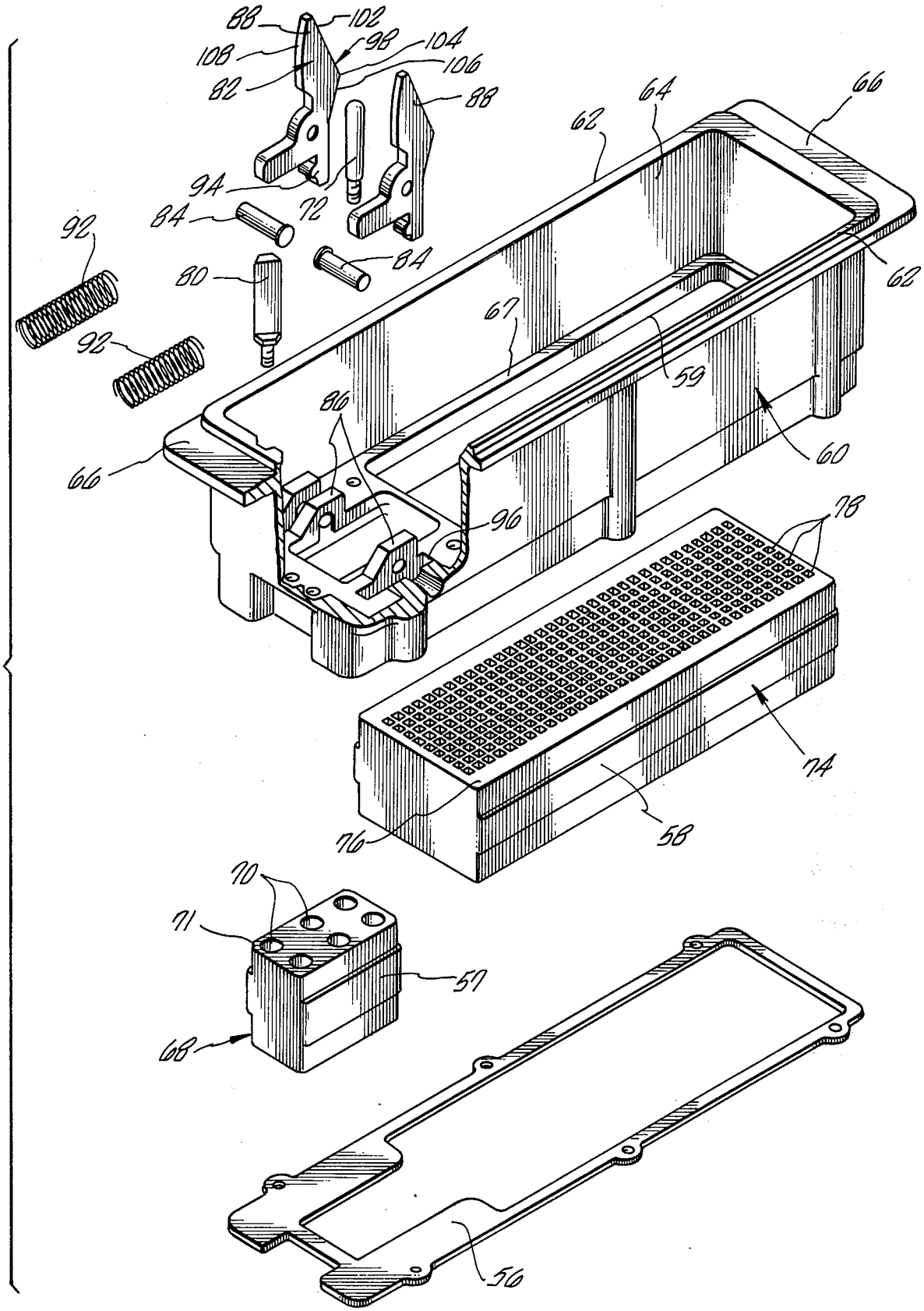
FIG. 6 is an exploded view, in perspective of the component elements of the modular unit-mounted connector mating portion shown in FIG. 4.
Figure 1:
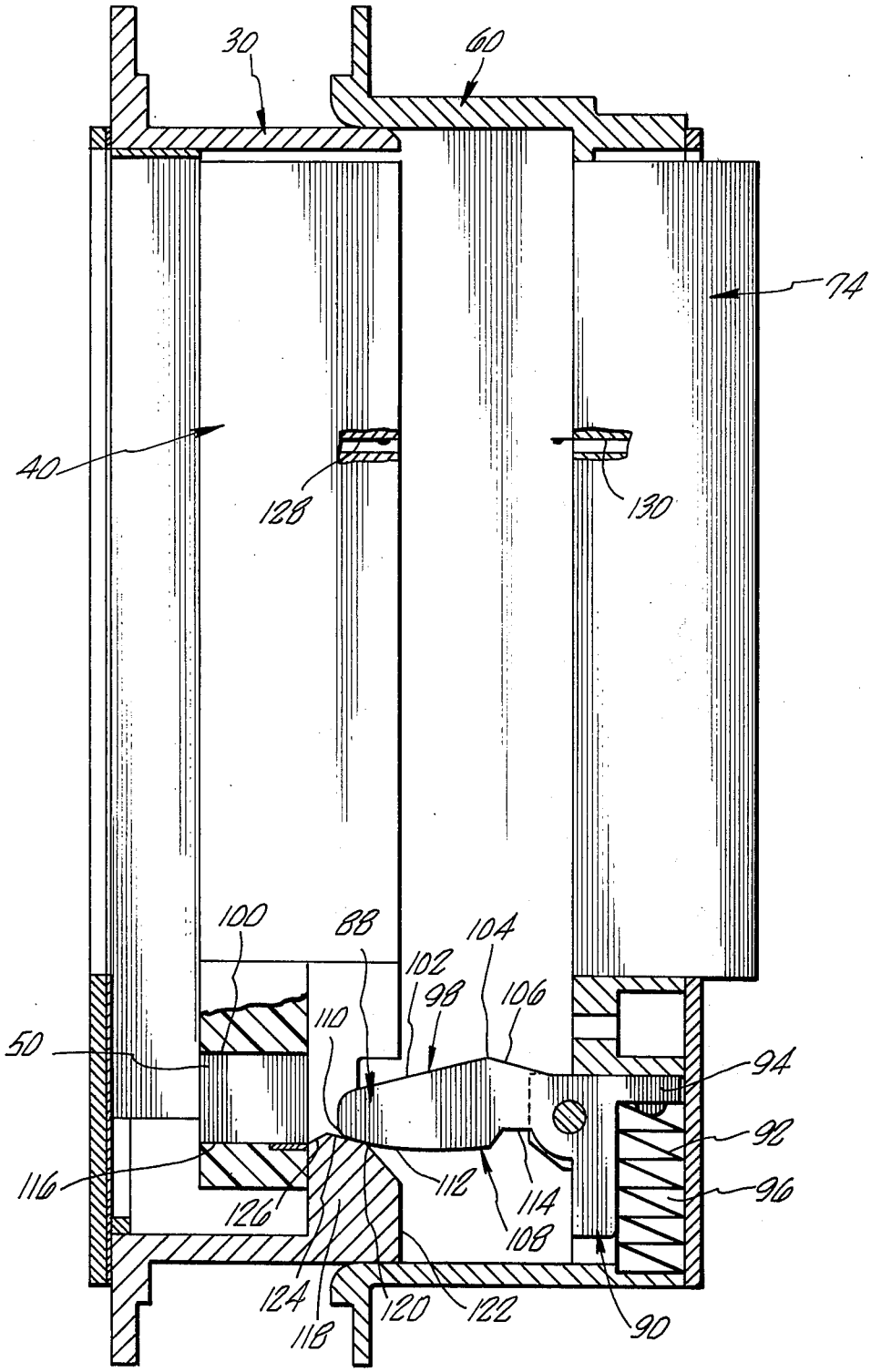
Figure 8:
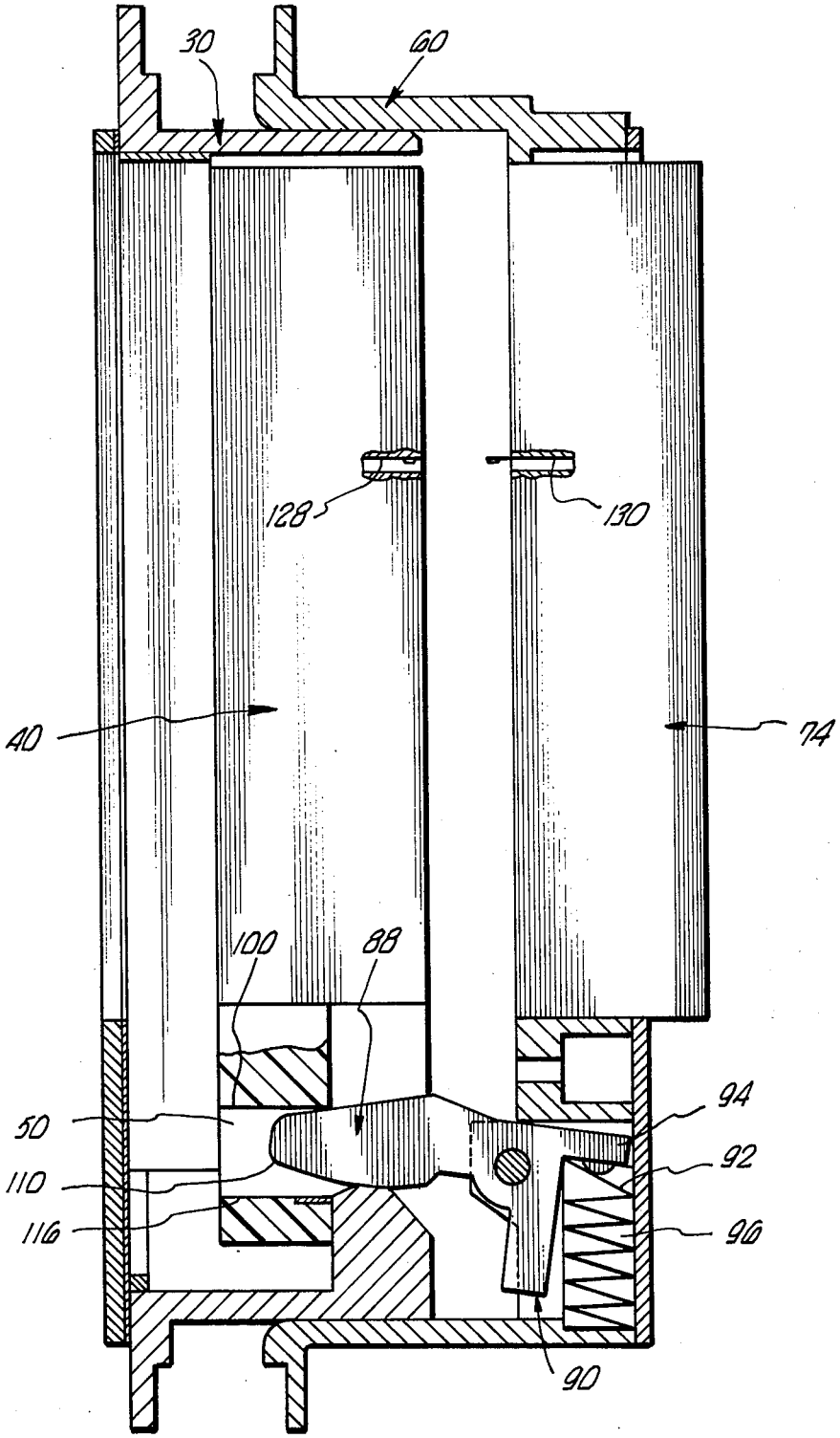
Figure 9:
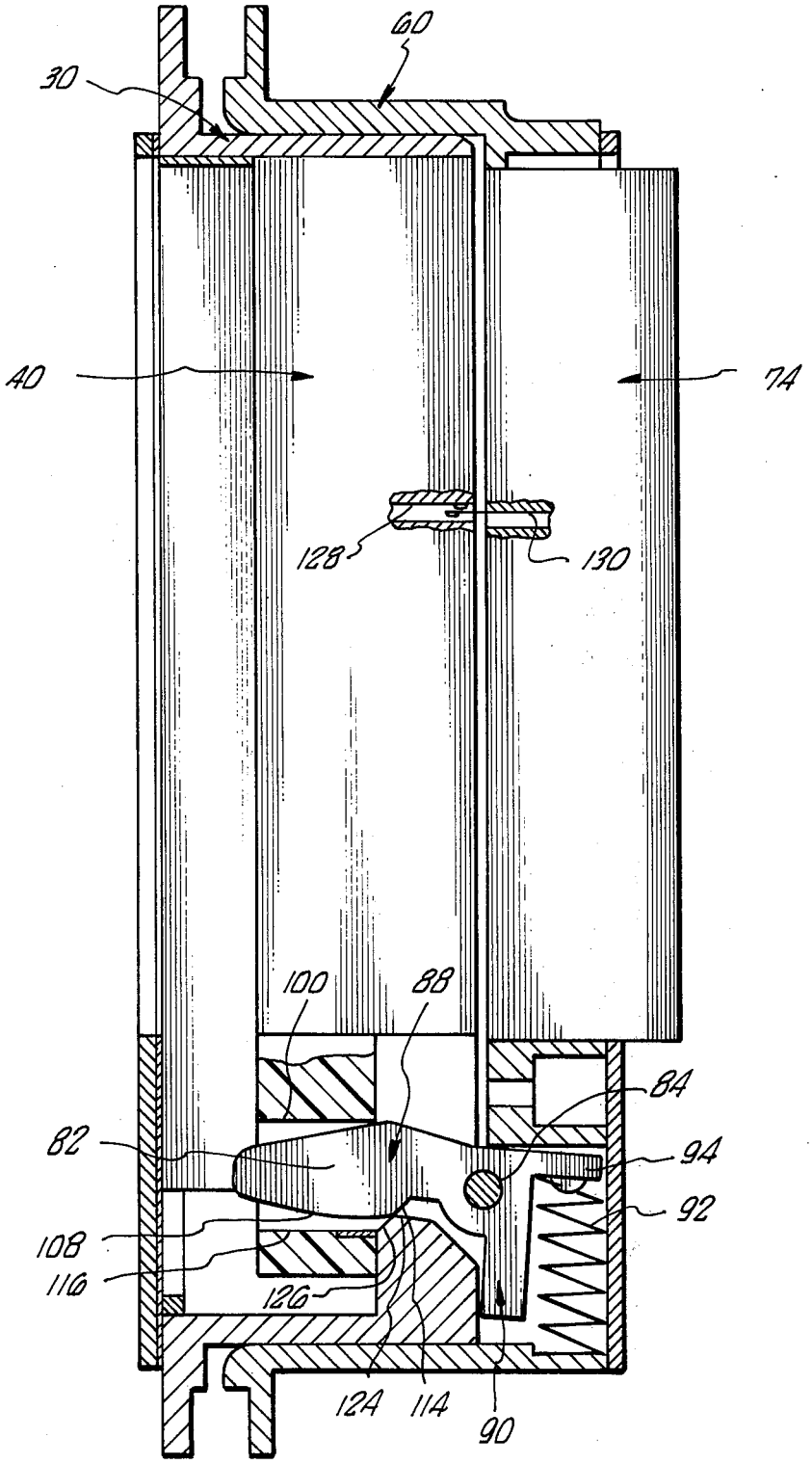
Figure 10:
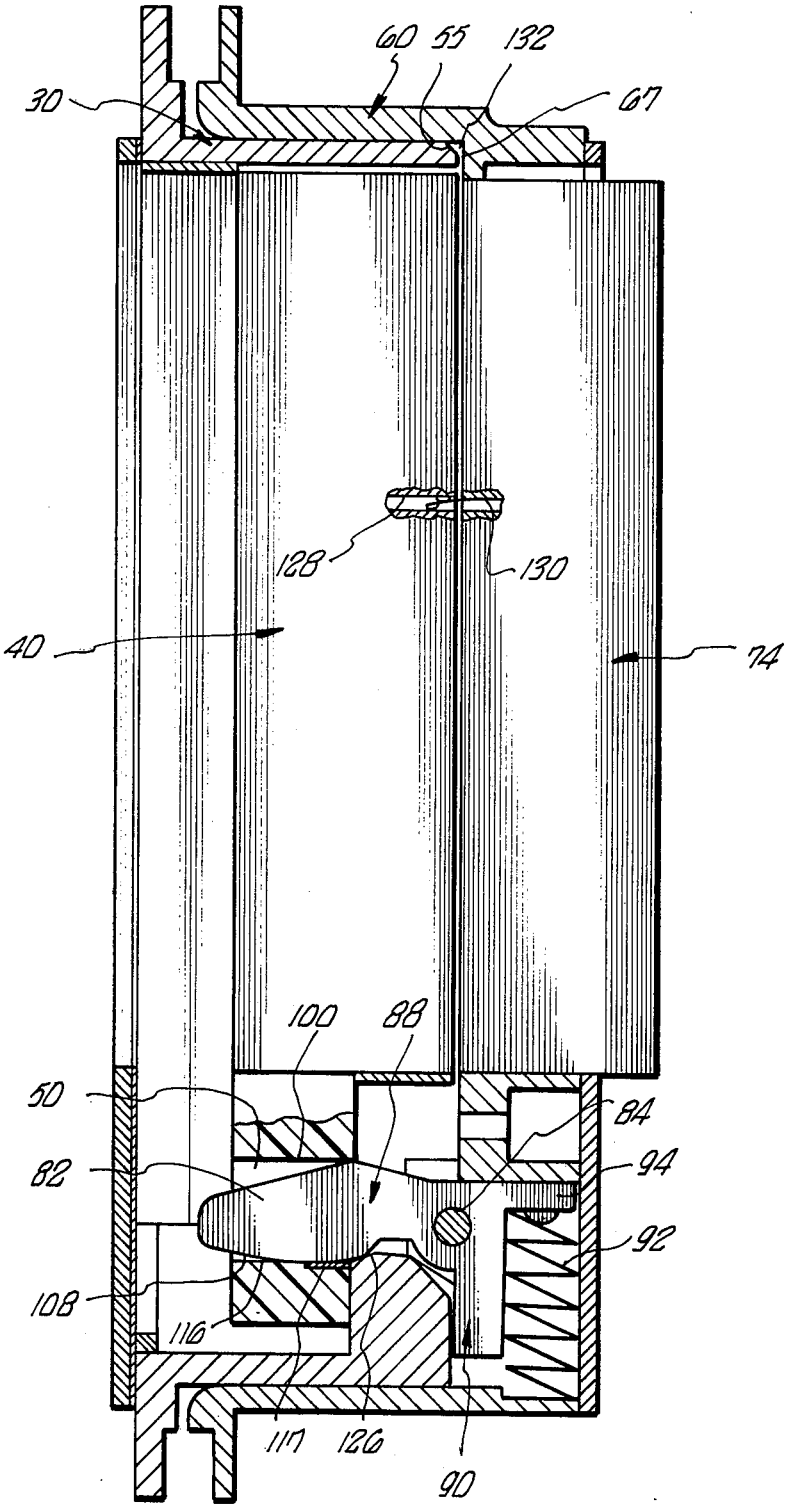
Figure 11:
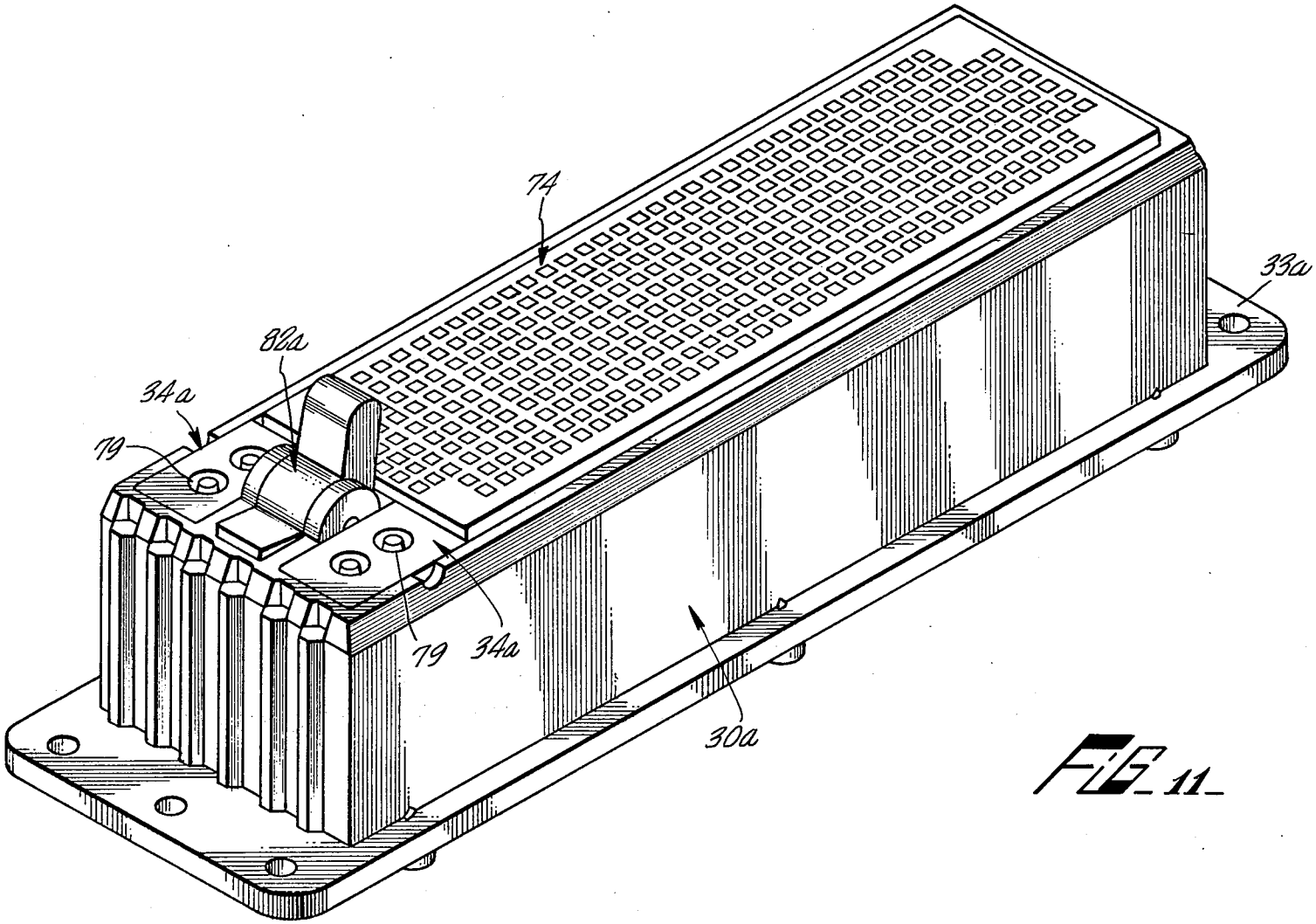
Figure 12:
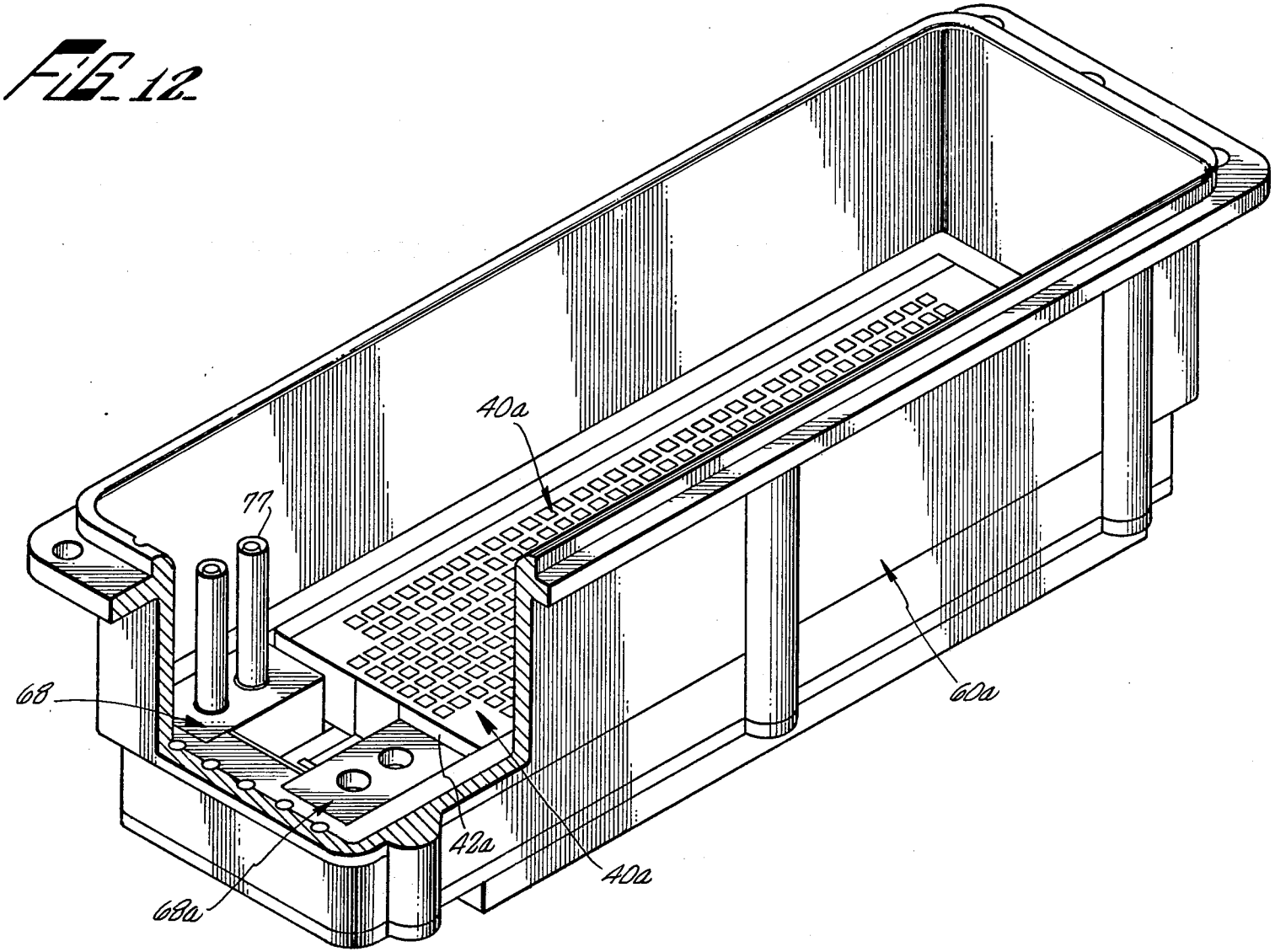
Figure 13:
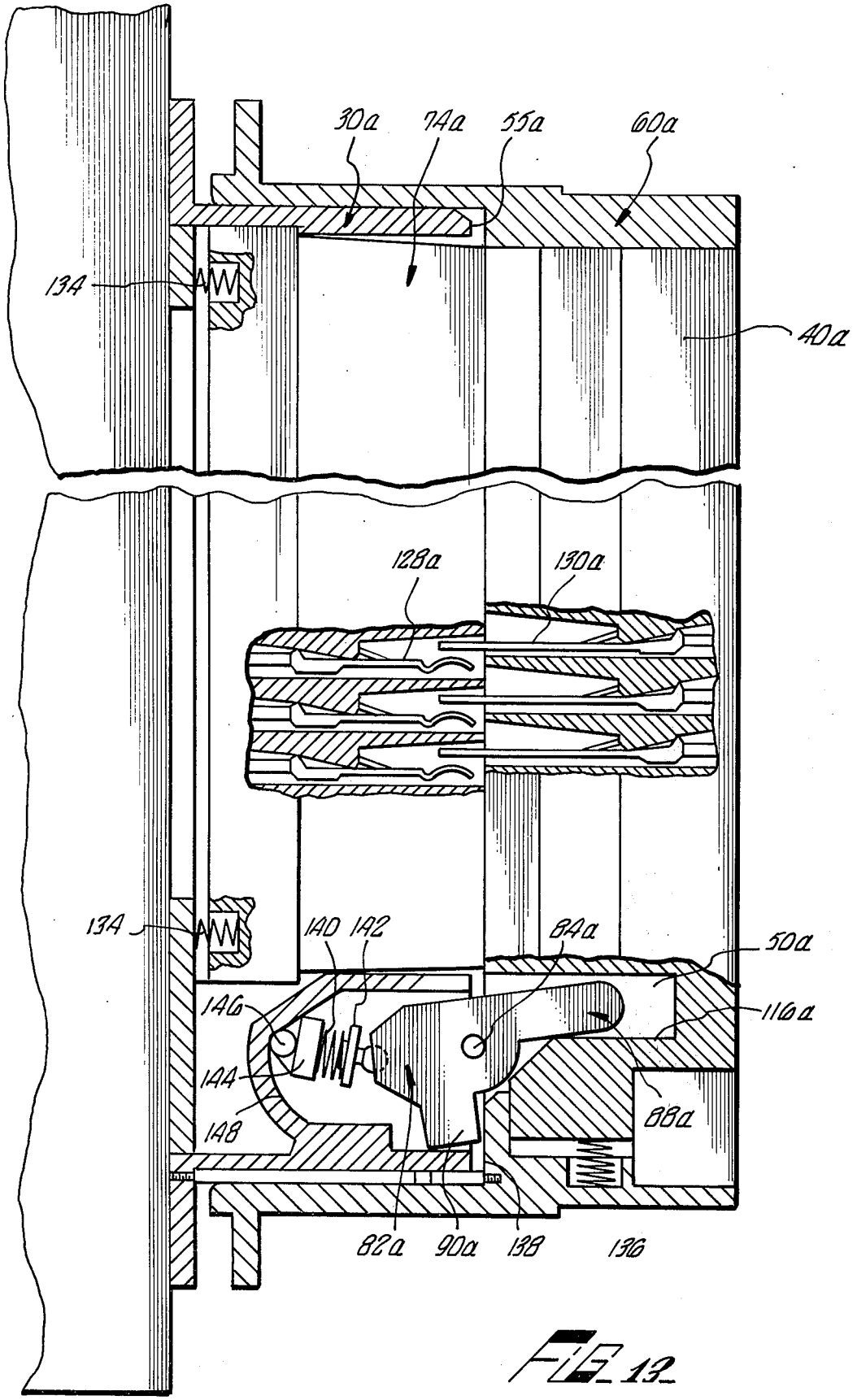
Figure 14:
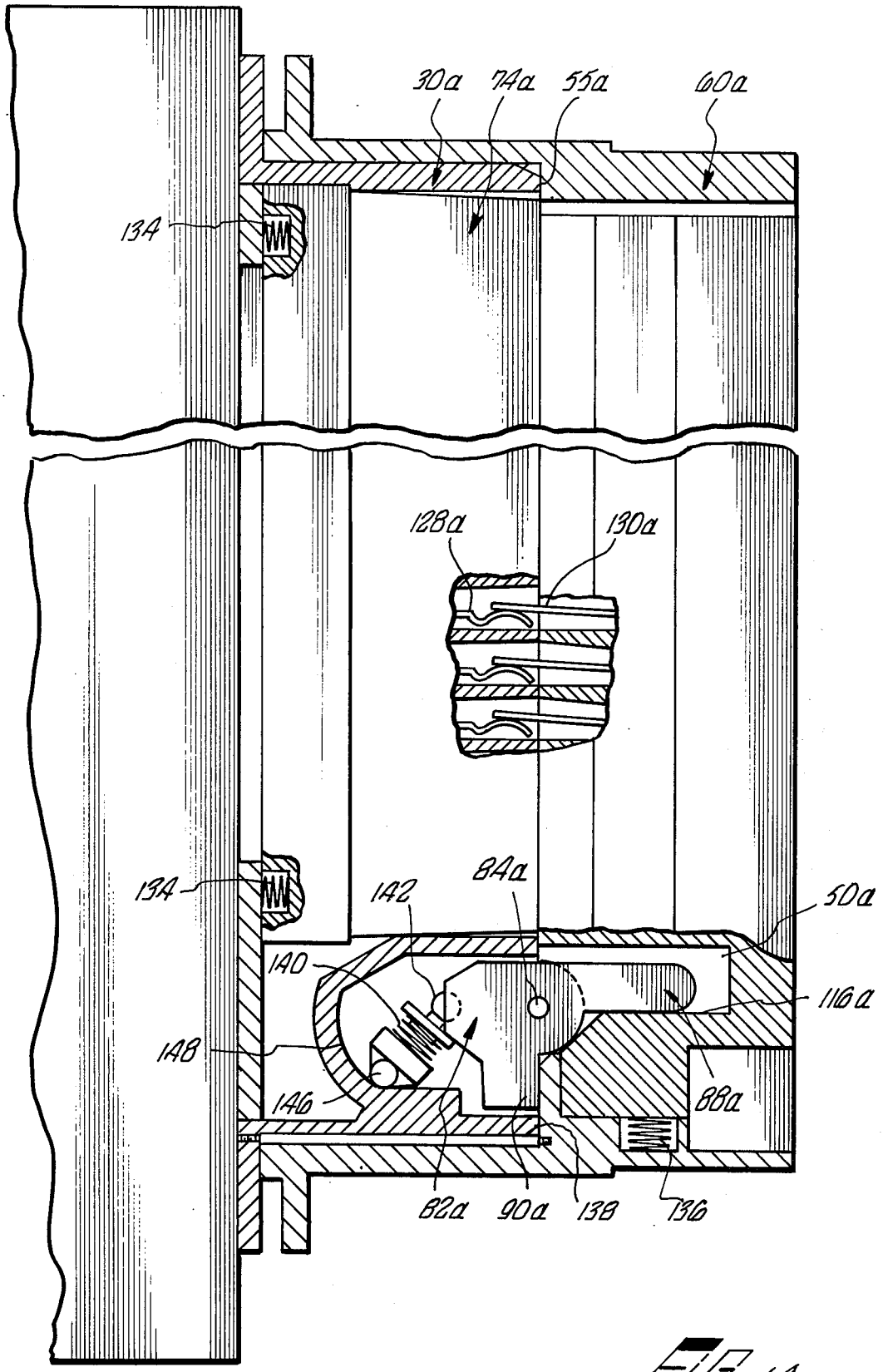
Figure 15:
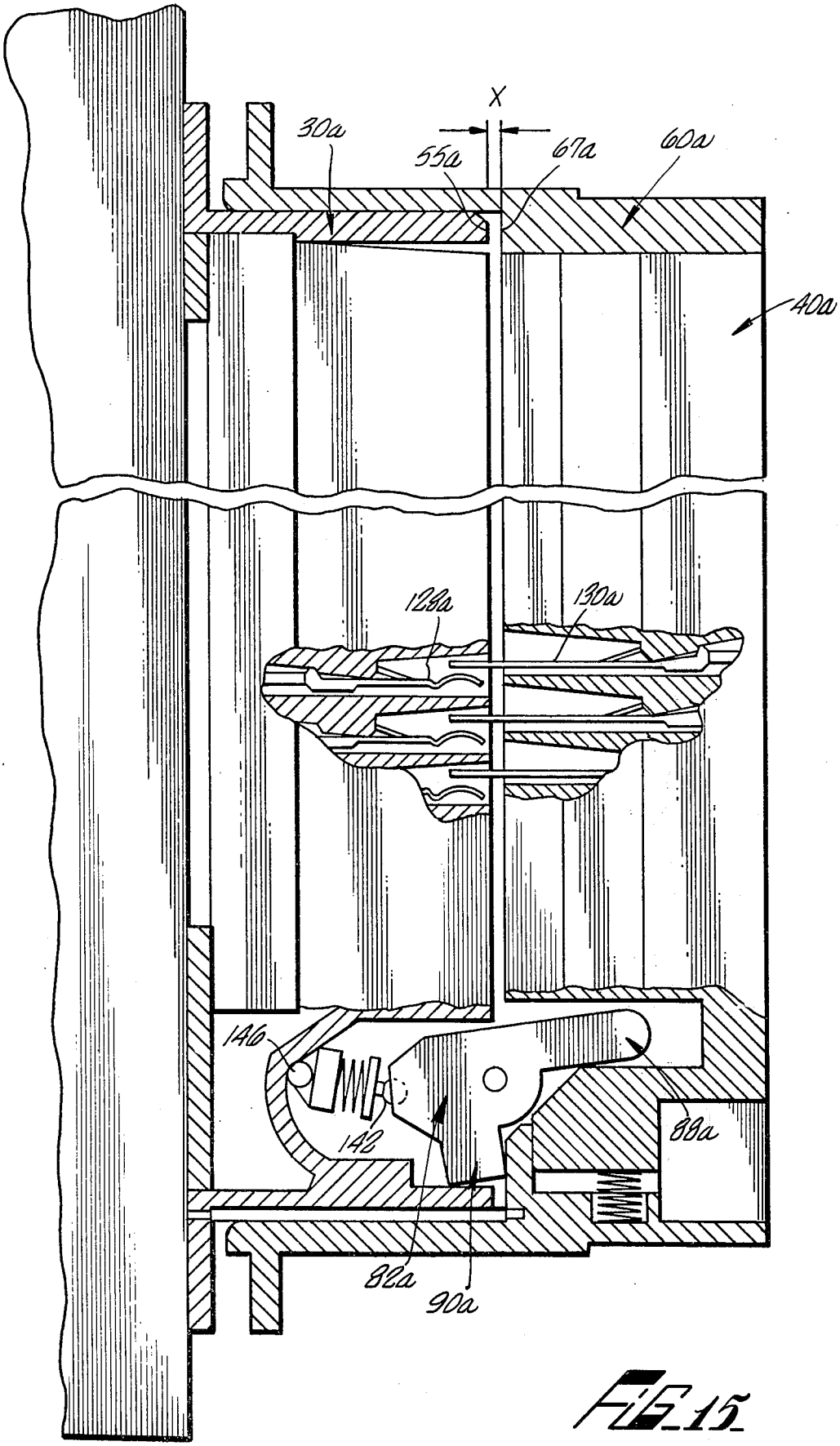
Figure 16:
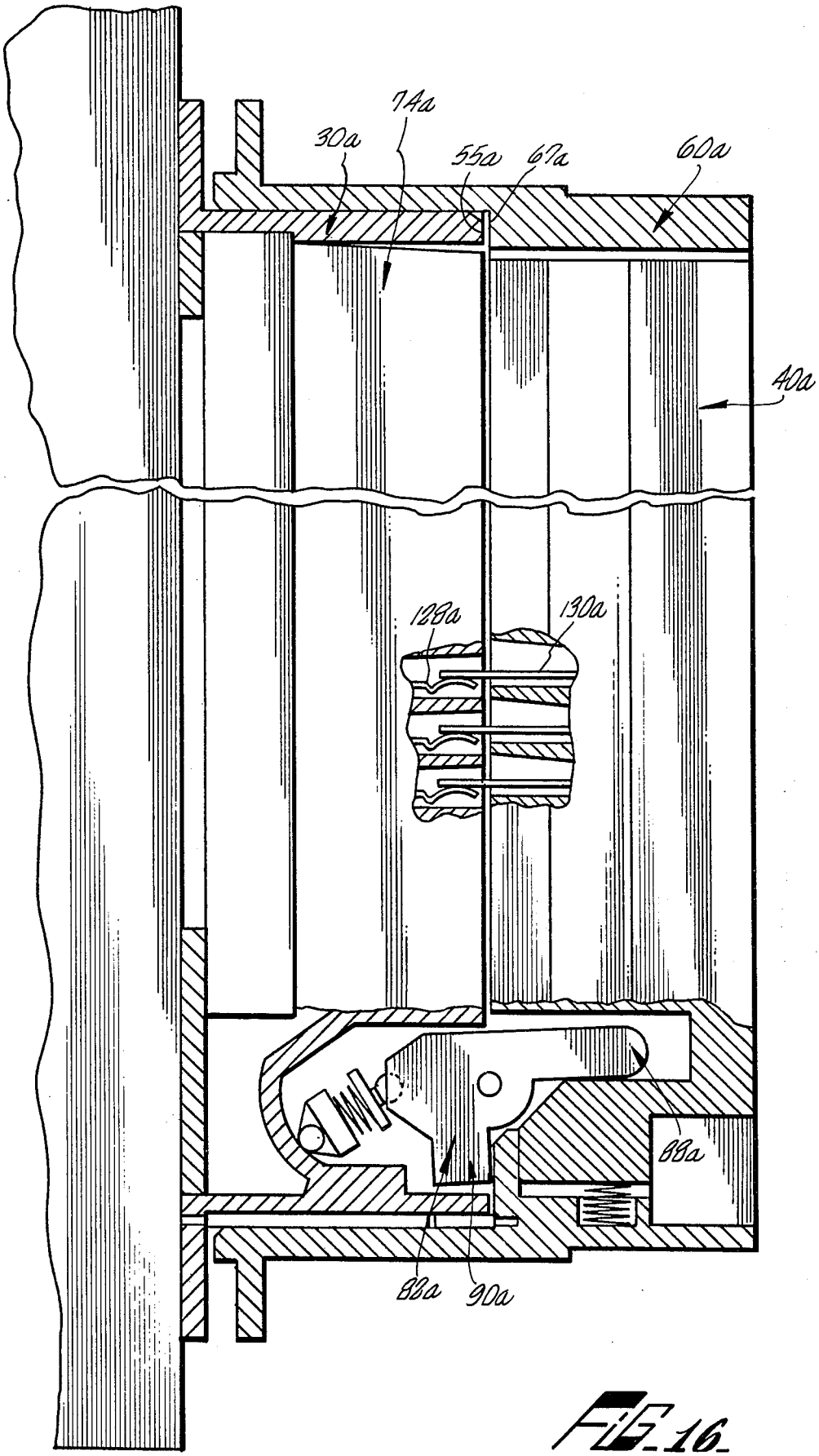

FIG. 11, which corresponds to FIG. 8 in the parent application, is a view, in perspective, of a male connector shell assembly;

FIG. 12, which corresponds to FIG. 9 in the parent application, is a view, in perspective, of a female connector shell assembly adapted to mate with the male shell assembly of FIG. 11;

FIG. 13, which corresponds to FIG. 6 in the parent application, shows the male and female connector portions of FIGS. 11 and 12 in their partially mated condition, prior to engagement of the low insertion force terminal elements;

FIG. 14, which corresponds to FIG. 7 in the parent application, shows the male and female connector portions of FIGS. 11 and 12 in their mated condition, after engagement of the low insertion force terminal elements;

FIGS. 15 and 16, which correspond respectively to FIGS. 10 and 11 of the parent application, show a modification of the structures of FIGS. 13 and 14 wherein "wiping" action of the low insertion force terminals is obtained. FIG. 15 shows the male and female connector portions in their partially mated condition before engagement of the low insertion force terminals. FIG. 16 shows the male and female connector portions of FIG. 15 just after engagement of the low insertion force terminals.

DETAILED DESCRIPTION OF THE SPECIFIC EMBODIMENTS

Inasmuch as FIGS. 1–4 of this application are identical with FIGS. 1–4 of our related co-pending application, Ser. No. 613,348, which is also a continuation-in-part of parent application Ser. No. 535,288, the initial portion of the description herein is substantially identical with the description of the same aspects of the related application.

Figure 1:
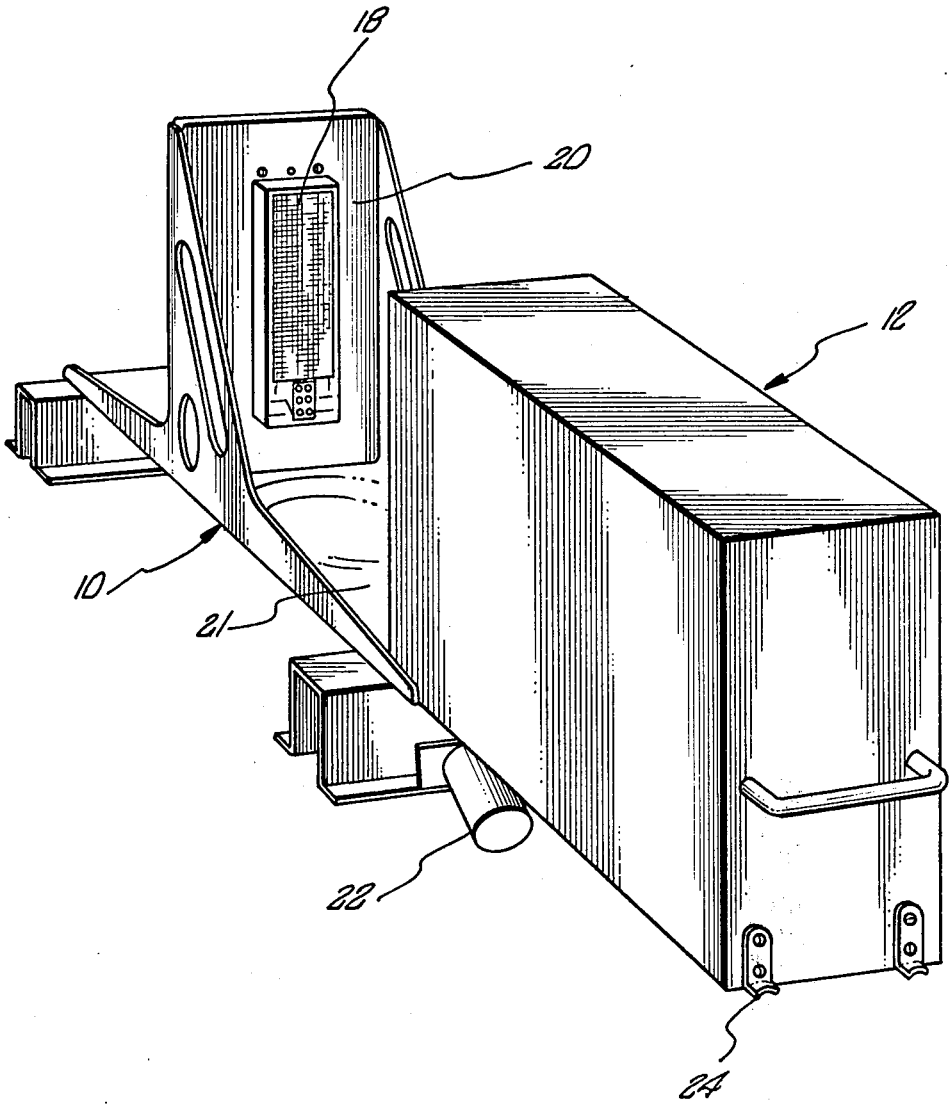
FIG. 1 is a view, in perspective, of a racking system, or "box and tray", or modular unit and shelf, combination, incorporating our improved electrical connector structure, the modular unit being shown in position on the shelf before its horizontal motion has been completed to bring the mating portions of the electrical connector together.
Figure 2:
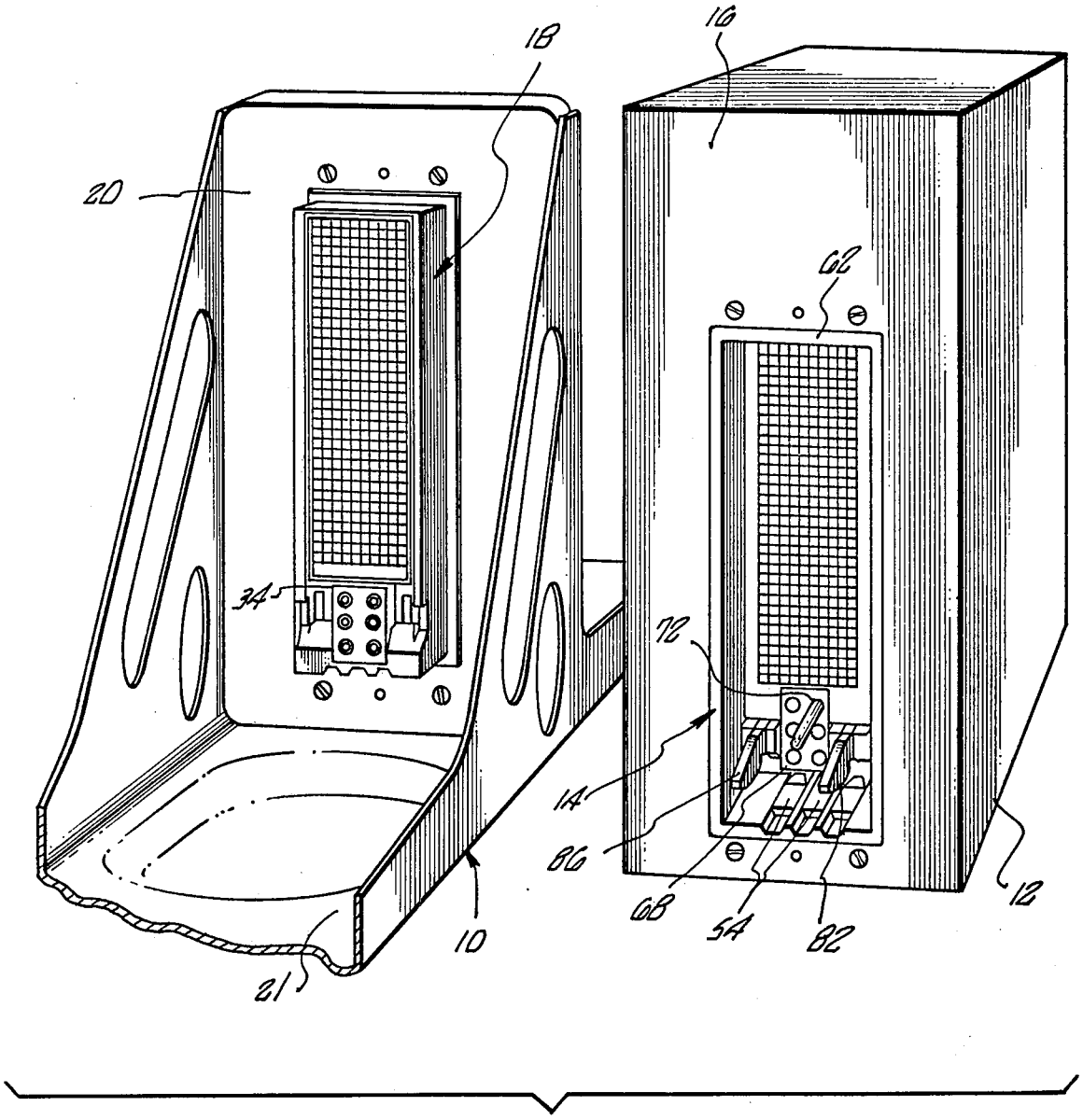
FIG. 2 shows separate perspective views of the modular unit and shelf of FIG. 1, prior to installation of the unit on the shelf, with both connector mating portions visible.

As shown in FIGS. 1 and 2, the racking system includes a supporting shelf, or tray, 10 and a modular removable component 12 supported thereon, which is normally enclosed in a container, or box, as shown. The supporting shelf is mounted "in place" on the vehicle, or other equipment, which uses the electrical and electronic systems which are to be interconnected. The most common use of such structures is in aircraft. The shelf is permanently mounted on the aircraft, and its connector unit is connected by wires to the electrical and electronic systems which are permanently installed on the aircraft. The box is a modular avionics component which can be readily replaced when necessary, and its connector unit is connected by wires to the electrical and electronic components inside the box. Insertion and removal of the box on the shelf requires readily connectable and disconnectable electrical connector terminals.

The electrical connector shown in FIG. 2 comprises a female, or receptacle, mating portion 14 secured to the end wall 16 of the modular unit 12, and a male, or plug, mating portion 18 secured to the vertical back portion, or backplate, 20 of the shelf 10. The male and female mating portions obviously could be reversed if preferred, with the female portion 14 secured to the backplate and the male portion 18 secured to the end wall of the box. The male and female mating portions should be located near the interface 21 of the shelf and the modular unit, in order to avoid mating problems which could result from deflection of the shelf or backplate under connector insertion forces.

In order to hold the annular unit in position on the shelf after the modular unit has been pushed along the shelf to bring the connector mating portions into their fully mated positions, a suitable hold-down mechanism is required, such as the mechanism disclosed in our U.S. Pat. No. 3,640,141, issued on Feb. 8, 1972. This hold-down mechanism also provides means for exerting insertion and extraction forces for those electrical terminals which require such forces, i.e., the coaxially, or telescopically, engaging terminals. In FIG. 1, a hold-down knob 22 is shown at one end of the shelf, which can be manually hooked to a bracket 24, on the rear wall of the modular unit 12 when the modular unit has been pushed into proximity to the backplate portion 20 of the shelf 10.

Figure 3:
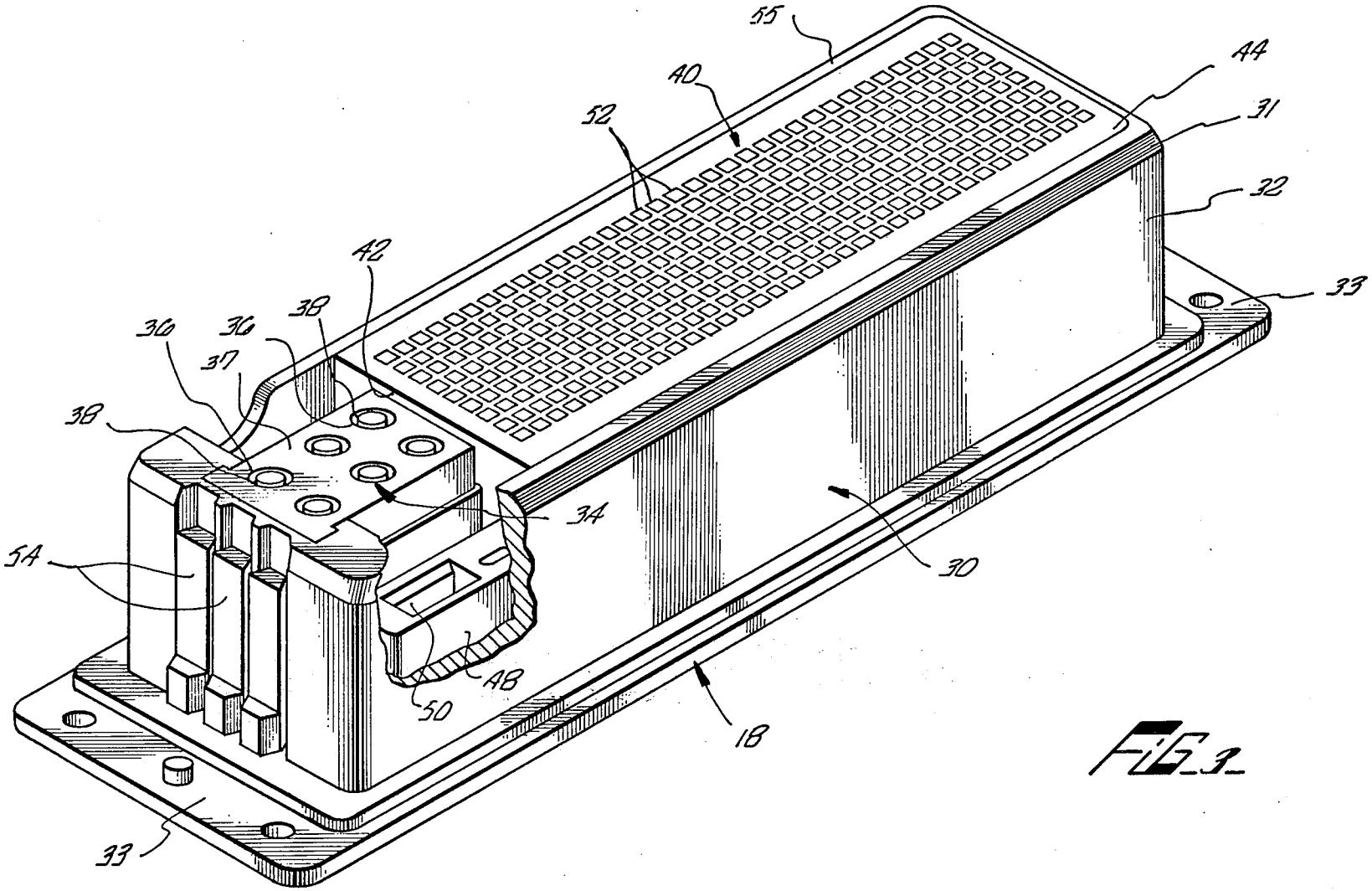
FIG. 3 is a close-up view, in perspective, of the shelf-mounted mating portion of the connector of FIG. 1.
Figure 5:
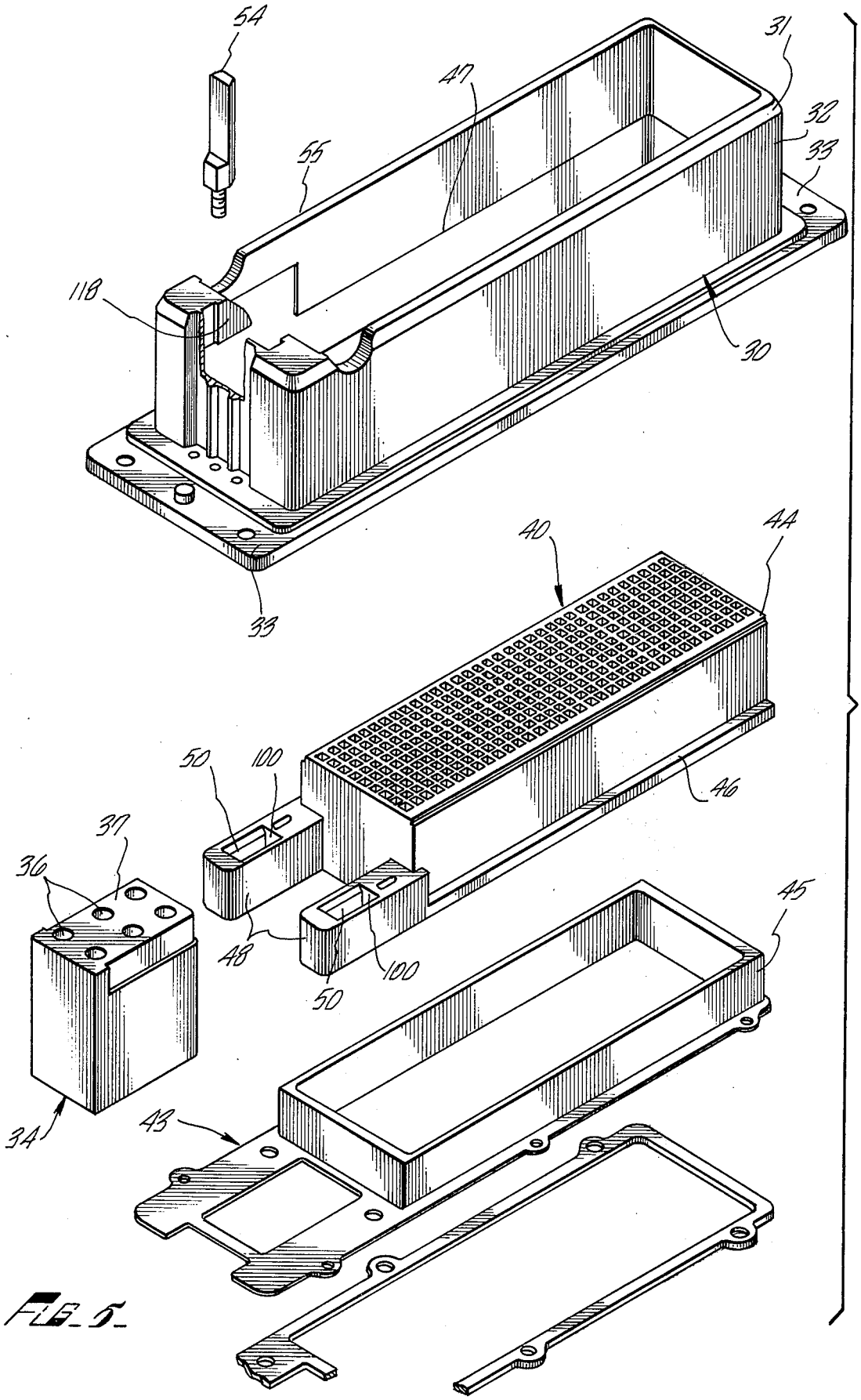
FIG. 5 is an exploded view, in perspective, of the component elements of the shelf-mounted connector mating portion shown in FIG. 3.

As shown in FIGS. 3 and 5, the male mating portion 18 of the connector comprises a metal shell, or housing, 30 which is designed to support and enclose the electric terminals contained therein, and also to cooperate with the female portion in guiding the terminals into engaging or overlapping position during the installation of the modular unit on the shelf. In order to facilitate its guiding inter-engagement with the female portion, the outer periphery of the male shell 30 preferably has a chamfered entering edge 31 and tapered side portions 32. The shell 30 has upper and lower flanges 33 by means of which it can be secured to either the modular unit or the shelf.

Supported inside the male shell 30 are at least two electric-terminal-providing members, each of which comprises an insulating support portion and a plurality of terminals carried thereby. One such member 34 is fixedly mounted in the vertically lower or bottom, part of the shell 30, and has a plurality of bores, or passages, 36, extending through its insulating support portion 37, in each of which passages is mounted one half of a pin-and-socket terminal pair. In the figure, the member 34 in the male shell is shown containing socket elements 38; however, the pin elements could be mounted in the member 34, if preferred. It is desirable that each socket element be held in place by a clip which permits a slight motion of the socket to adjust for any misalignment with its entering pin.

The second electric-terminal-providing member in the male shell is the member 40, located vertically above the member 34. The member 40 is prevented from horizontal movement in the shell, but is permitted limited verical movement, as shown, by the space 42 (in FIG. 3) between member 40 and member 34.

Since relative motion between the member 40 and the male shell 30 is preferably caused by a lever, or cam, arrangement, we have provided two extensions 48 integral with member 40 and and extending downwardly therefrom on opposite sides of member 34, each of which extensions 48 has a slot 50 adapted to receive one end of a lever which is carried by the female shell.

Member 40 has a large number of terminal-containing-passages, or channels, 52 extending through its insulating support portion 44. These passages are preferably rectangular in cross-section because each of them houses a terminal element which moves into and out of contact by relative lateral, or transverse, movement with respect to its contacting terminal, i.e., movement at least partially in the plane of, or in a plane parallel to, the interface of the two mating shells (male and female). Details concerning these terminal elements will be explained more fully below. When reference is made herein to "lateral" or "sideward" movement of the terminal elements into contact position, that does not imply horizontal movement. Actually, the movement in the described embodiment is vertical. What is meant is that interengagement of the terminals results from their relative motion in a direction which is at least partially transverse, or normal, to the axial or telescoping motion of the shells into mating engagement.

The male shell 30 also carries suitable indexing pins 54, which cooperate with corresponding indexing means on the female portion to prevent accidental interconnection of the wrong modular unit and shelf combination.

Figure 4:
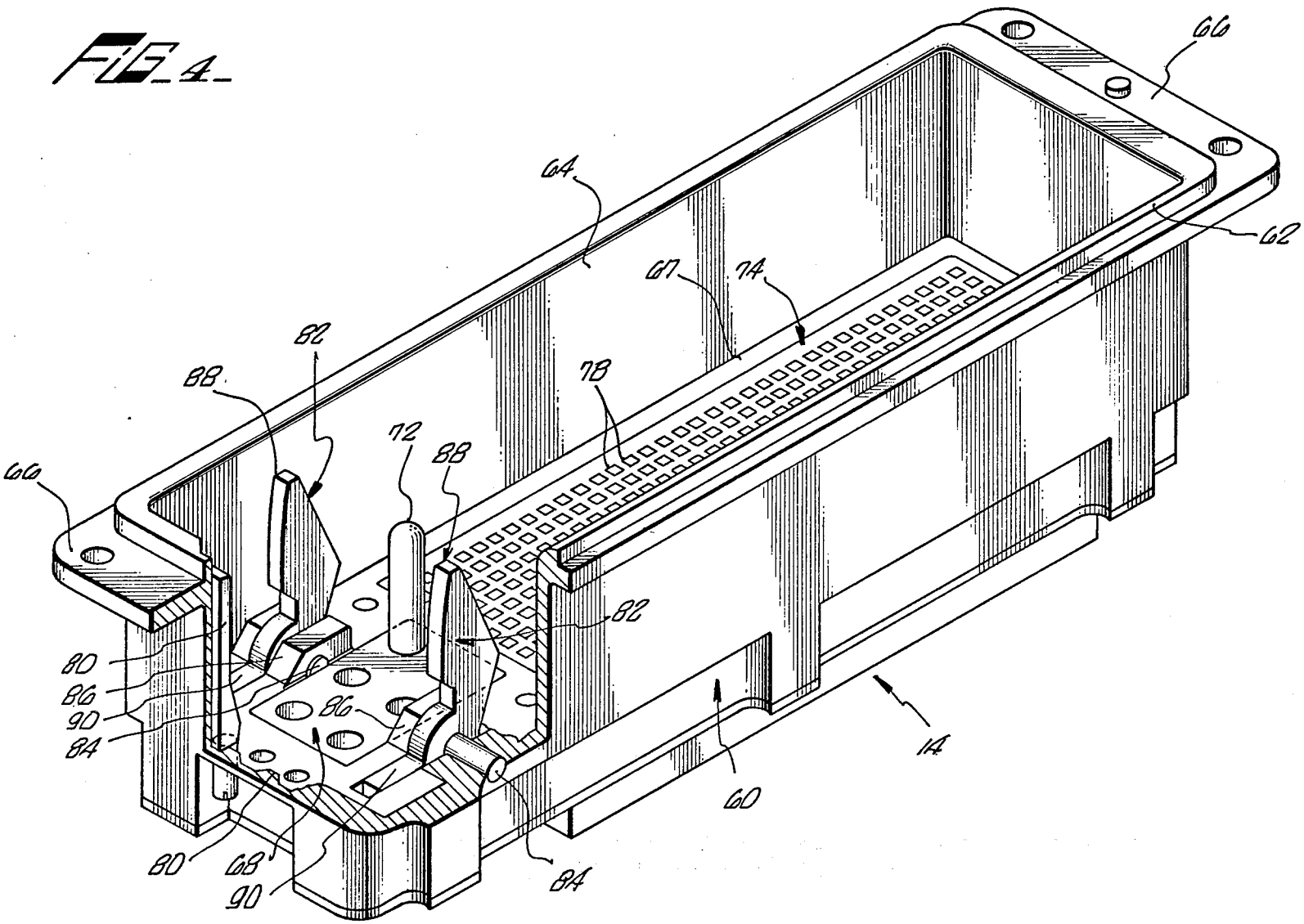
FIG. 4 is a close-up view, in perspective, of the modular unit-mounted mating portion of the connector of FIG. 1.

As shown in FIGS. 4 and 6, the female mating portion 14 of the connector comprises a metal shell, or housing, 60 which is designed to support and enclose the electrical terminals contained therein, and also to cooperate with the male portion in guiding the terminals into engaging or overlapping position during the installation of the modular unit on the shelf. In order to facilitate its guiding inter-engagement with the male portion, the inner periphery of the shell 60 preferably has a convex-curved edge 62 which initially receives the male shell, and tapered side portions 64. The shell 60 has upper and lower flanges 66 by means of which it can be secured to either the modular unit, or the shelf.

When the male and female shells 30 and 60 are brought together, they provide a close-tolerance fit of the outer periphery of the male shell inside the inner periphery of the female shell, thereby guiding the coaxial, or telescoping, terminals into engagement. Misalignment, if any, between the shells can be compensated for either by a slight lifting of the end of the modular unit nearest the backplate, or by permitting a slight floating movement of the connector shell mounted on the modular unit. The male and female shells reach their "bottomed", or fully-mated positions when the edge surface 55 on the male shell engages the surface 67 inside the female shell. (Note the locations of the bottoming surfaces 55 and 67 in FIGS. 3 and 4).

Supported inside the female shell 60 are at least two electric-terminal-providing members, each of which comprises an insulating support portion and a plurality of terminals carried thereby. One such member 68 is fixedly mounted in the vertically lower, or bottom, part of the shell 60, and has a plurality of bores, or passages, 70, extending through its insulating support portion 71, in each of which passages is mounted one half of a pin-and-socket terminal pair. In the figure, the member 68 is shown containing pin elements 72 (only one of which is shown, in order not to block other details of the figure). Socket elements, instead of pin elements, could be carried by member 68, if preferred. It is desirable that each of the pin elements 72 be held in place by a clip which permits a slight motion of the pin to adjust for any misalignment with its receiving socket.

The second electric-terminal-providing member in the female shell is the member 74, which is also fixedly mounted in the shell and which is located vertically above the member 68. The insulating support portion 76 of member 74 has a large number of terminal-containing passages, or channels, 78 extending therethrough. These passages are preferably rectangular in cross-section because each of them houses a terminal element which moves into and out of contact by relative lateral, or transverse, movement with respect to its contacting terminal, i.e., movement at least partially in the plane of, or in a plane parallel to, the interface of the two mating shells (male and female). Details concerning these terminal elements will be explained more fully below.

The female shell 60 carries suitable indexing pins 80 which cooperate with the indexing pins 54 on the male shell.

The exploded views in FIGS. 5 and 6, show additional details of both the male and female portions. In FIG. 5, the member 43 is designed to be clamped between retaining plate 44 and the body of the shell, and has a spacing flange 45 which holds the member 40 in the desired position when the parts have been assembled. In assembled position, the ledge 46 on member 40 is retained between a shoulder 47 on the metal shell and the spacing flange 45 by the retaining plate 44 which is secured to flange 33. Member 34 is retained between plate 43 and portion 118 of the metal shell. In FIG. 6, a retaining plate 56 is used to hold shoulders 57 and 58 formed in members 68 and 74 against a shoulder 59 in the metal shell.

This patent application differs from our co-pending application Ser. No. 613,348, in placing emphasis on our means for causing the low insertion force terminals to move into interengaging position. Not only do we accomplish this automatically for the first time; but also we have a very simple and fool-proof device which insures proper interengagement and retention of the connector terminals until disconnection is required. Disconnection also is quickly and conveniently accomplished.

Automatic force-transmitting means are provided for causing the low insertion force terminals to come into interengagement as the male and female shells 30 and 60 are moved into mated position. This is accomplished by devices which convert the relative axial, or telescoping, motion of the two mating shells into transverse, or lateral, motion of the movable electric-terminal-providing member 40, thereby bringing its terminals into engagement with the terminals of member 74 in the other shell.

In the preferred embodiment, as seen in FIGS. 3–9, the automatic force-transmitting means comprises two identical levers 82 mounted in the female shell 60 on opposite sides of the lower electric-terminal-providing member 68. The reason for using two levers 82 is to provide redundancy, which insures that the terminal engaging mechanism will function even if one of the levers is damaged. In other words, either lever can itself accomplish the function of causing engagement and disengagement of the low insertion force terminals.

Each lever 82 is pivotally supported on a pin 84 which is retained in a protruding portion 86 of the metal shell. Each lever has an arm 88 adapted to enter the corresponding slot 50, and an arm 90 adapted to engage the other mating portion of the connector when the two shells are brought into mated position. Thus, force on arm 90 from its engagement with shell 30 as the two shells are mated rotates the lever 82 in the counterclockwise direction, as seen in FIG. 4, thereby causing the arm 88 in slot 50 to move the member 40 downwardly (see FIG. 3).

Each lever 82 is spring-biased in a direction tending to move member 40 downwardly. This may be accomplished by a compression spring 92 acting against a third arm 94 on the lever and supported in a slot 96 provided in the shell 60.

The arm 88 of each lever is also designed to function as a sliding cam, or wedging means, as it moves into the slot 50. It thereby causes the member 40 to be positively held in its upper, or non-terminal-engaging position, until the final part of the mating movement of the two shells. The upper side 98 of the lever arm 88 has a sloping, or inclined plane, surface adapted to engage the top surface 100 of the slot 50 (see FIGS. 7–9). The upper surface 98 has a rising entry slope 102 culminating at a high point 104, and a declining slope 106 at its other end. The lower surface 108 of the lever arm 88 has a rounded entering edge 110, followed by a convexly curved surface 112, and culminating in a sharply insloping indentation 114 (about a 45° slope). The lower side 108 of the lever arm 88 has engagement, as the shells are mated, first with the metal shell 30, and then with the bottom surface 116 of the slot 50. To reduce wear of the surface 116, a metal insert 117 is embedded in its front portion.

During the intermediate portion of the movement of lever arm 88 into slot 50, the lever arm exerts an upward force on member 40 by virtue of the engagement of the upper side 98 of the lever arm with the top surface 100 of the slot. During the final portion of the movement of lever arm 88 into slot 50, the lever arm exerts a downward force on member 40 by virtue of the engagement of the lower side 108 of the lever arm with the bottom surface 116 of the slot.

The pivotal movements of the lever arm 88, which is urged counterclockwise by spring 92, are controlled by two factors: (a) engagement of the lower side 108 of the lever arm 88 with a camming surface provided by the shell 30 in front of member 40; and (b) engagement of the lever arm 90 with the front of shell 30 near the end of the mating motion of the two shells. The lower side 108 of lever arm 88 has a sliding cam, or wedging, relationship with the portion 118 of shell 30 located in front of member 40. The portion 118 of the shell has an upwardly sloping convexly curved ramp 120 which begins at the front surface 122 of the bottom of the shell. Behind the ramp is a short, substantially level surface 124, followed by a sharp drop off surface 126, (about a 45° slope), the contiguous surfaces 124 and 126 providing a latching projection for cooperation with indentation 114 in lever arm 88. The camming shape of portion 118 of the shell initially forces the lever arm 88 upwardly against the force of spring 92, and at the end of the mating stroke the upward projection of portion 118 of the shell fits into the indentation 114 in the lower surface of the lever arm 88. At that point, the lever arm has returned to its lowermost position under the force of shell surface 122 acting against lever arm 90, assisted by the force spring 92.

Operation of the automatic terminal-engaging means is shown in FIGS. 7–10 in successive stages as the connector shells are moved to mated position.

In FIG. 7, the male shell 30 has just entered the female shell 60. The arm 98 of each lever arm 88, which is shown mounted in the female shell, is just engaging the camming portion 118 of the male shell. As surface 112 of the lever rides up surface 120, the lever is rotated clockwise, compressing spring 92. In order to reduce the friction between surfaces 112 and 120, a roller could be supported on either the camming portion 118 or the lever arm 98. In this figure, the movable terminal-providing-member 40 is usually in its lower position because of gravity.

In FIG. 8, the male and female shells 30 and 60 have been further pushed toward fully mated positions. The lever 88 has moved clockwise, and its upper surface 98 is pushing against the top surface 100 of slot 50. This urges member 40 upwardly, thereby insuring that the terminal elements 128 and 130 will not engage one another as they move toward overlapping positions.

FIG. 9 shows the terminal elements 128 and 130 in overlapping, but non-engaging position. The front surface 122 of male shell 30 is ready to engage the lower arm 90 of lever 82. Also, the 45° sloping surface of indentation 114 is ready to slide down the 45° sloping surface 126. Once this slide begins, under the force of surface 122 acting against lever arm 90, assisted by spring 92 acting on the lever arm 94, the lower surface 108 of lever arm 88 will engage the bottom 116 of slot 50, and will move member 40 downwardly to bring the terminals 128 and 130 into engagement. The high point 104 on the upper surface 98 of arm 88 is very near the edge of slot 50.

FIG. 10 shows the male and female shells 30 and 60 about .015 inches (see space 132) from fully mated, or bottomed, position, in which edge 55 on the male shell engages the shoulder 67 on the female shell. The dimensions are somewhat exaggerated in the figure, in order to provide a cleaner showing. The lower surface 108 of arm 88 is in engagement with insert 117 in the bottom 116 of slot 50, and is pushing member 40 downwardly, reducing the space 42 between it and members 34. The terminal elements 128 and 130 are in engagement with one another.

Since the slope of indentation 114 has already started down sloping surface 126, the parts will continue to move rapidly toward bottomed position. However, this transitory position is shown in the figure to illustrate the "wiping" action which occurs between the terminal elements 128 and 130. Since the terminal elements are already in engagement, their additional relative axial motion will cause a sliding friction between them, which is considered beneficial in cleaning off any surface dirt or other impurities which might interfere with the electrical conductivity from one terminal element to the other.

When it is necessary to remove the modular unit 12 from the shelf 10, either because it needs repair or because a functionally different unit is desired, it is a simple matter to reverse the installation steps, and manually disengage the modular unit. After disconnecting the holding mechanism 22-24, the installer pulls the modular unit away from the backplate 20. Initially, a somewhat higher force is required for disengagement because of the resistance of each spring 92 and because each lever 82 has to move back up the surface 126.

Summarizing briefly the description of the preferred embodiment, it will be apparent that the objective of providing a simplified and error-proof installation of a connector having low insertion force contacts, or terminals, has been accomplished. As the modular unit 12 is pushed along the shelf 10 toward backplate 20, the male and female mating portions 18 and 14 are pushed into mated position. During the final portion of this exertion of horizontal force to "push home" the modular unit, the levers 82 automatically cause downward, or transverse, motion of the member 40 which brings the terminal elements 128 and 130 into engagement with one another. As soon as the modular unit has been "pushed home", and the connector portions are in fully mated position, the installer will secure the holding mechanism 22-24 which retains the modular unit in its installed position until its removal is desired. No further steps by the installer are necessary; and the risk is eliminated of equipment failure due to omission of a separate camming procedure needed to engage the low insertion force terminal elements.

Another embodiment of the invention is shown in FIGS. 11–14. As stated above, these figures correspond to FIGS. 6–9 in parent application Ser. No. 535,288, but their order has been altered, and the identifying numerals have been changed. Elements in FIGS. 10–13 which correspond functionally to elements in the FIGS. 1–9 of this application, are given the same numerals plus the letter "*a*".

FIG. 11 shows a male plug, or shell; and FIG. 11 shows female receptacle, or shell. These are generally similar to the male and female connector mating portions of FIGS. 3 and 4. However, there is only one camming lever **82*a* shown in FIGS. 11–14, and its structure and operation differ somewhat from the levers in FIGS. 3 and 4, although the end results are the same. In both cases relative telescoping movement of the two mating shells into mated position causes the camming lever to move the movable terminal-supporting member in one of the shells laterally, or transversely, into position wherein its terminals engage side-to-side with the corresponding terminals in the other shell. The camming lever 82*a* shown in FIG. 11 is supported on the male shell 30*a*, instead of the female shell 60*a*. With the lever 82*a* supported on the male shell, it is necessary that the movable insulating support member be mounted inside the female shell. Specifically, as shown in FIG. 12, an electric-terminal-providing member 40*a* is movably supported in the female shell 60*a*, i.e., it can move up and down in the shell but is restrained from horizontal movement. The member 40*a*, in the non-mated position of the shells, is separated vertically from the two members 68*a* in female shell 60*a* by a space 42*a*. Because only one centrally located camming lever 82*a* is used in FIGS. 11–14, the pin-and-socket, or telescoping, terminals are supported in two insulating support members 68*a* located at opposite sides of the camming lever. The terminals shown in FIGS. 11 and 12 are terminals of the co-ax type, i.e., they have two separate electrical paths, one an internal pin-and-socket connection, and the other a connection in which both terminals are annular. The inner and outer co-ax terminals are separated from one another by an annular insulating wall. One or more of the pin-and-socket connections 72-38, shown in FIGS. 3 and 4, may be combined in the same electric-terminal-providing member (34-68 or 34*a*-68*a*) with one or more of the co-ax terminals 77-79 of FIGS. 11 and 12**.

The pin-and-socket connectors are generally used as the "power" connectors, i.e., the means for carrying the higher amperages needed to supply electrical power.

The co-ax terminals are generally used for low energy signals.

FIGS. 13 and 14 show in cross-section the male and female shells as they approach mated position. The male and female connector portions of FIGS. 13 and 14 are similar in many respects to those of the preceding figures, but they are so arranged that there is no "wiping" action of the side-engaging terminals. In this embodiment the terminal-providing member 74*a* in the male shell 30*a* has a limited telescoping, or in-and-out (horizontal) motion with respect to the shell. Springs 134 urge member 74*a* to the left (in the figures) causing it to protrude slightly beyond the bottoming edge 55*a*. Once the terminal elements 128*a* and 130*a* engage one another, further mating motion of the shells does not cause sliding of the terminal elements on one another because their frictional engagement moves member 74*a* in its shell against the light force of springs 134. This embodiment was conceived when the prevailing theory considered wiping action to be undesirable because of the frictional resistance encountered in pushing the connector portions together.

The specific functioning of lever 82*a* is best understood by referring to FIGS. 13 and 14. FIG. 13 shows the shells 30*a* and 60*a* close to bottomed position; and FIG. 14 shows them in bottomed position. Lever 82*a* is pivotally supported at 84*a* on the male shell 30*a*. It has a lever arm 88*a* adapted to engage the bottom surface 116*a* of slot 50*a*, in member 40*a* and thus, can exert a downward force on member 40*a* against the resilient force of one or more springs 136. The lever 82*a* also has an arm 90*a* which is adapted to engage the surface 138 on female shell 60*a* near bottomed position of the shells, thereby causing clockwise movement of lever 82*a* and converting the horizontal force used to push the modular unit toward the backplate into transverse, or vertical, force pushing lever arm 88*a* downwardly to move member 40*a*.

This embodiment has an over-center spring arrangement which causes a resilient force to be exerted on lever 82*a* tending to rotate it in one direction when the shells are disengaged, and to rotate it in the other direction when the shells are fully engaged. As shown in FIG. 13, a spring 140 is compressed between a member 142 which has pin-and-socket engagement with the lever 82*a* and a member 144 which carries a roller 146 that engages, and is adapted to move along, a curved surface, or cam track, 148 provided in the body of the male shell 30*a*. In the position of the connector shells in FIG. 13, the roller 146 is at the top of the curved surface 148, and urges the lever 82*a* in the counterclockwise direction, because of the direction of the line of force of the spring relative to pivot 84*a*. Also in this position, the point of engagement of member 142 against the lever is farther from the upper end of curve 148 than from its lower end, so the spring force holds the over center device in that position. When surface 138 pushes the lever in a clockwise direction, it moves the spring over center, so that its line of force now lies on the other side of pivot 84*a*; and therefore, the spring urges lever 82*a* in the clockwise direction (see FIG. 14). At the same time, the relative distances from the lever engagement with member 142 to the upper and lower ends of curve 148 have reversed, causing the roller 146 to its lower end.

When the connector shells are disengaged to remove the modular unit, spring 136 causes the lever to return to its initial position, and the roller moves back to the top of surface 148; so the force of spring 140 once again urges the lever in the counterclockwise direction (see FIG. 13).

The connector shown in FIGS. 15 and 16 is generally similar to that shown in FIGS. 13 and 14, except that the member 74*a* is not telescopically movable with respect to male shell 30*a*. Accordingly, relative frictional motion of the terminal elements 128*a* and 130*a* after they engage is not prevented by motion of member 74*a*. As shown in FIG. 16, the terminal elements 128*a* and 130*a* are already in engagement, even though a slight clearance, or space, 132*a* remains between surface 55*a* on male shell 30*a* and and surface 67*a* on female shell 60*a*. Therefore, a wiping action will occur between the terminal elements as the connector shells are pushed to their fully mated, or bottomed, position. The purpose of this wiping action has been explained above in the description of the preferred embodiment.

The following claims are intended to express the inventive scope of applicants' contribution to the art. Various modifications may be made in utilization of the present invention without departing from the spirit and scope of the claimed contribution.

What is claimed is:

1. For use in an electrical connector racking system which comprises a previously-installed supporting member adapted to be connected to "in place" electrical equipment, and a modular, readily removable member supported on the supporting member and requiring electrical interconnection with said "in place" equipment, an electrical connector comprising:

a first connector shell adapted to be mounted on one of the members;

a second connector shell adapted to be mounted on the other member in alignment with the first connector shell and adapted to mate with said first connector shell;

a first electric-terminal-providing means mounted at least partially within one of the connector shells and carrying a plurality of side-engaging terminals;

a second electric-terminal-providing means movably mounted at least partially within the other connector shell and carrying a plurality of side-engaging terminals disposed to engage the side-engaging terminals of said first means when said second means is moved relative to its connector shell; and force transmitting means for automatically moving said second means to automatically bring its side-engaging terminals into engagement with the corresponding terminals of said first means.

2. The electrical connector of claim 1 wherein the force transmitting means is responsive to a force which is exerted to move the connector shells into mated position.

3. The electrical connector of claim 1 wherein said second means is capable of linear transverse movement with respect to said other connecter shell and the force transmitting means converts force exerted in the direction necessary to mate the connector shells into a force acting transversely to said direction and applies said transversely acting force to said second means.

4. The electrical connector of claim 3 wherein the force transmitting means comprises at least one lever means which is pivotally supported on one of the connector shells and which has a first arm adapted to engage said second means and a second arm adapted to engage the other connector shell when the two connector shells are brought together.

5. The electrical connector of claim 4 wherein the lever arm adapted to engage said second means has a wedging relation thereto which provides a force on said second means holding its terminals out of engagement during the initial portion of the relative mating motion of the two connector shells.

6. The electrical connector of claim 3 wherein the force transmitting means comprises a plurality of lever means each of which is capable of performing the force transmitting function independently.

7. The electrical connector of claim 1 wherein the force transmitting means comprises a force exerting member on one connector shell and a force receiving surface on the other connector shell.

8. The electrical connector of claim 4 further including:

spring means biasing the lever means toward the position in which said second means is in terminal-engaging position; and a camming surface located on said other connector shell which initially engages the first arm of the lever means to move said lever means against the biasing force of the spring means.

9. For use as one mating portion of an electrical connector unit including a complementary mating portion for mating telescopically along an axis with said one mating portion:

a housing structure;

a supporting member so mounted inside the housing structure as to permit its relative transverse motion with respect to said housing and said axis;

a plurality of electric terminal elements mounted on the supporting member and initially so located as to lie adjacent to but separated from respective corresponding electric terminal elements in the complementary mating portion when the mating portions are moved axially toward one another; and force receiving surface means in said housing for adapting said supporting member to automatically undergo said transverse motion in response to motion of the complementary mating portion along said axis.

10. For use in an electrical connector racking system which comprises a previously installed supporting member adapted to be connected to "in place" electrical equipment, and a modular, readily removable member supported on the supporting member and requiring electrical interconnection with said "in place" equipment, an electrical connector comprising:

a shell adapted to be mounted on the modular member;

another shell adapted to be mounted on the supporting member in alignment with the shell on the modular member;

an electric-terminal-providing member including a support portion mounted inside one of the shells and a plurality of side-engaging terminals carried thereby;

another electric-terminal-providing member including a support portion movably mounted inside the other shell and a plurality of side-engaging terminals carried thereby and adapted to engage the aforementioned side-engaging terminals when moved sideward as the movable support portion is moved relative to its shell; and means responsive to relative telescoping movement of the two shells for automatically moving the movable support member and its side-engaging terminals into engagement with the corresponding terminals after the two shells have been brought together.

11. The electrical connector of claim 10 wherein the means for automatically moving the movable support member brings the support member and its side-engaging terminals into engagement with the corresponding terminals after the two shells have been brought together, but before the shells have reached their final interconnected position.

12. An electrical connector comprising:

a male shell;

a female shell adapted to mate with the male shell;

a first electric-terminal-providing member fixedly supported inside one of the shells, said first member including an insulating support portion and a plurality of laterally-engagable terminals carried thereby;

a second electric-terminal-providing member supported inside the other shell and laterally movable therein, said second member including an insulating support portion and a plurality of laterally-engagable terminals carried thereby and movable therewith into and out of engagement with the terminals on the first member;

the outer periphery of the male shell being dimensioned to closely mate with the inner periphery of the female shell when the two are brought together, thereby guiding the shells as they are brought into mating position; and means responsive to mating motion of the male and female shells for moving the second member laterally to bring its terminals into engagement with those of the first member after the shells have been moved into mated position.

13. The electrical connector of claim 12 wherein at least one terminal of each of the laterally interengaging pairs of terminals has lateral flexibility permitting it to deflect after terminal engagement.

14. The electrical connector of claim 12 wherein the means for moving the second member laterally brings its terminals into engagement with those of the first member after the shells have been moved into mated position but before the shells have reached their final interconnected position.

15. In a racking system adapted to removably retain an electrical equipment module on a mounting tray, and having means for moving the module on the tray, the improvement comprising:

a first terminal supporting member having a plurality of first terminals extending adjacent one surface of the first supporting member, the first supporting member being operatively mounted on the module;

a second terminal supporting member having a plurality of second terminals extending adjacent one surface of the second supporting member, the second supporting member being operatively mounted on the tray;

said plurality of first terminals and plurality of second terminals being relatively movable automatically into overlapping but noncontacting positions during the first portion of the modules insertion movement on the tray; and transmitting means associated with the module movement for causing movement of the module on the tray subsequent to said first portion to move one of said first and second plurality of terminals in its entirety so as to effect electrical contact between said first and second plurality of terminals.

16. The racking system improvement of claim 15 wherein the transmitting means is responsive to relative motion of the module and tray toward one another to exert a transverse force to move said first plurality of terminals and second plurality of terminals into electric contact.

17. In a racking system including an equipment module removably retained in a rack, an electrical connector which comprises:

a first terminal carrying member secured to the rack and having a plurality of first terminals positioned thereon;

a second terminal carrying member secured to the module and having a plurality of second terminals positioned thereon;

the first and second terminals being arranged to be positioned in an overlapping but non-contacting relationship when the module is moved into a first mating position with respect to the rack; and transmitting means carried by the module or the rack and arranged to automatically move the terminal carrying members transversely with respect to each other to cause the overlapping terminals to make contact when the module is moved beyond the first mating position with respect to the rack.

18. An electrical connecting structure comprising:

a supporting body constituting the first part of an electrical connector having first and second parts which electrical connector is connected by relative axial movement;

an electric-terminal-providing member retained on and movable transversely relative to the supporting body;

a plurality of side-engaging terminals carried by said member and movable into electrical contact with terminals in said second part when said member is moved transversely; and means responsive to axial motion of the body into its connected position for moving said member transversely.

19. The electrical connecting structure of claim 18 wherein the means responsive to axial motion of the body causes transverse movement of the member when the body still has a slight axial distance to move before reaching its fully connected position.

20. The electrical connecting structure of claim 18 wherein the means responsive to axial motion includes a resilient over-center device which first resists and then assists the movement of said means during axial motion of the body toward connected position and which first resists and then assists the movement of said means during axial motion of the body away from connected position.

21. A low insertion force electrical connector comprising:

first and second connector halves;

a first plurality of electrical terminals mounted in one of said connector halves;

a terminal block means mounted for transverse movement in the other of said connector halves;

a second plurality of electrical terminals, each attached to said terminal block means; and means mounted in said first and second connector halves for automatically controlling the position of said terminal block means as said connector halves are mated to effect automatic side-engagement between said first plurality and second plurality of electrical terminals.

22. A pair of mating electrical connectors comprising:

a first connector shell;

a second connector shell adapted to mate with said first connector shell;

a first element mounted in conjunction with one of said connector shells and having a substantially planar face;

a plurality of electrical terminals carried by said first element and disposed in the planar face of said first element, substantially perpendicular thereto;

a second element mounted in conjunction with the other of said connector shells, for relative motion with respect thereto and having a substantially planar face;

a plurality of second electrical terminals carried by said second element and disposed in the planar face of said second element, substantially perpendicular thereto and such that each said second terminals are spaced slightly apart from a corresponding first terminal; and means in said first and second shells cooperating as said shells are mated to automatically move said second element to bring each of the corresponding first and second terminals into contact.

* * * * *